US010654670B2

(12) United States Patent
Washino

(10) Patent No.: US 10,654,670 B2
(45) **Date of Patent: *May 19, 2020**

(54) CONVEYING APPARATUS AND IMAGE RECORDING APPARATUS

(71) Applicant: BROTHER KOGYO KABUSHIKI KAISHA, Nagoya-shi, Aichi-ken (JP)

(72) Inventor: Yoshiyuki Washino, Gifu-Ken (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/152,692

(22) Filed: Oct. 5, 2018

(65) Prior Publication Data

US 2019/0135563 A1 May 9, 2019

Related U.S. Application Data

(63) Continuation of application No. 15/417,749, filed on Jan. 27, 2017, now Pat. No. 10,106,345.

(30) Foreign Application Priority Data

Jan. 29, 2016 (JP) ..... 2016-016634

(51) Int. Cl.
*B65H 1/30* (2006.01)
*B41J 13/10* (2006.01)
(Continued)

(52) U.S. Cl.
CPC ..... *B65H 1/30* (2013.01); *B41J 11/58* (2013.01); *B41J 13/103* (2013.01); *B65H 1/08* (2013.01);
(Continued)

(58) Field of Classification Search
CPC ..... B65H 5/00; B65H 29/00; B65H 83/00; B65H 2405/33; B65H 2405/31;
(Continued)

(56) References Cited

U.S. PATENT DOCUMENTS 8,469,352 B2 * 6/2013 Kunioka ..... B41J 13/106 271/164
8,625,173 B2 1/2014 Asada et al.
(Continued)

FOREIGN PATENT DOCUMENTS

JP 2007-217140 A 8/2007
JP 2012-250845 A 12/2012
JP 2013-112508 A 6/2013

OTHER PUBLICATIONS

Notice of Reasons for Rejection issued in corresponding Japanese Patent Application No. 2016-016634, dated Nov. 19, 2019.

*Primary Examiner* — David H Bollinger
(74) *Attorney, Agent, or Firm* — Merchant & Gould P.C

(57) ABSTRACT

There is provide a conveying apparatus conveying a sheet including: a main body formed with a conveyance path; a first feed tray installable in the main body at a first position; a discharge tray; and a first regulating section performing regulation for regulating movement of the first tray, in a state of being located at a second position, toward the other side in a first direction. The first regulating section is configured to release the regulation, in a case that the first feed tray, at the second position, is moved upwardly by a first predetermined moving amount. A spacing distance in the up/down direction between the first feed tray and the discharge tray is shorter than the first predetermined moving amount. The discharge tray is configured to be move upwardly by being contacted with the first feed tray in a case that the first feed tray is moved upwardly.

8 Claims, 11 Drawing Sheets

(51) Int. Cl.

| | |
|---|---|
| ***B65H 31/02*** | (2006.01) |
| ***B41J 11/58*** | (2006.01) |
| ***B65H 1/08*** | (2006.01) |
| ***B65H 1/26*** | (2006.01) |
| ***B65H 31/22*** | (2006.01) |
| ***G03G 15/00*** | (2006.01) |

(52) U.S. Cl.
CPC ..... *B65H 1/266* (2013.01); *B65H 31/02* (2013.01); *B65H 31/22* (2013.01); *G03G 15/6529* (2013.01); *B65H 2301/4212* (2013.01); *B65H 2405/332* (2013.01); *B65H 2405/3322* (2013.01); *G03G 15/6502* (2013.01); *G03G 15/6511* (2013.01)

(58) Field of Classification Search
CPC .... B65H 2405/3322; B65H 3/44; B65H 1/04; B65H 2405/3321; B65H 2405/332; B65H 1/30; B65H 1/08; B65H 1/266; B65H 3/22; B41J 11/58; G03G 15/6529
USPC ..... 271/9.11, 3.14, 4.01
See application file for complete search history.

(56) References Cited

U.S. PATENT DOCUMENTS

| | | | | |
|---|---|---|---|---|
| 8,681,400 | B2 | 3/2014 | Miura et al. | |
| 8,794,620 | B2 | 8/2014 | Wakakusa et al. | |
| 10,106,345 | B2 * | 10/2018 | Washino | B41J 11/58 |
| 2006/0071389 | A1 * | 4/2006 | Kozaki | B65H 3/0669 271/9.11 |
| 2007/0196155 | A1 | 8/2007 | Asada et al. | |
| 2011/0285074 | A1 | 11/2011 | Shiohara et al. | |
| 2012/0313310 | A1 | 12/2012 | Kunioka | |
| 2013/0001850 | A1 | 1/2013 | Okano et al. | |
| 2013/0134660 | A1 | 5/2013 | Idehara et al. | |
| 2013/0168916 | A1 | 7/2013 | Takahata | |
| 2013/0256984 | A1 | 10/2013 | Samoto et al. | |
| 2014/0002561 | A1 | 1/2014 | Aoki et al. | |
| 2015/0042030 | A1 | 2/2015 | Washino | |
| 2015/0158681 | A1 | 6/2015 | Aoki | |
| 2017/0113894 | A1 * | 4/2017 | Zou | B65H 31/22 |

* cited by examiner

CONVEYING APPARATUS AND IMAGE RECORDING APPARATUS

CROSS REFERENCE TO RELATED APPLICATION

This application is a Continuation of U.S. patent application Ser. No. 15/417,749 filed on Jan. 27, 2017 which claims priority from Japanese Patent Application No. 2016-016634 filed on Jan. 29, 2016 the disclosure of which is incorporated herein by reference in its entirety.

BACKGROUND

Field of the Invention

The present teaching relates to a conveying apparatus configured to convey a sheet, and an image recording apparatus including the conveying apparatus and configured to record an image on a sheet conveyed by the conveyance apparatus.

Description of the Related Art

Many image recording apparatuses, such as printers, etc., each including a conveying apparatus configured to convey a sheet, are provided with a feed tray which supports the sheet fed to such an image recording apparatus. The feed tray is insertable and removable with respect to the image recording apparatus. The feed tray is removed from or detached from the image recording apparatus when sheets are supplemented (replenished) or changed.

Further, the image recording apparatuses adopt a configuration in which the feed tray can be maintained in a state that the feed tray is drawn midway with respect to the image recording apparatus, to thereby allow the supplement or change of the sheets can be performed without removing the feed tray completely from the image recording apparatus. Furthermore, the image recording apparatuses also adopt a configuration in which the feed tray can be maintained in a state of being installed in the image recording apparatus, to thereby prevent the feed tray installed in the image recording apparatus from inadvertently or unintentionally being removed or detached from the image recording apparatus. Such an image recording apparatus is provided with a mechanism configured to maintain or hold the feed tray in the state that the feed tray is drawn midway with respect to the image recording apparatus and a mechanism configured to maintain the feed tray in the state that the feed tray is installed in the image recording apparatus. Moreover, in such an image recording apparatus, the holding of the feed tray is configured to be releasable or disengageable so as to allow the feed tray to be removed from the image recording apparatus.

Conventionally, there is known an image recording apparatus wherein a forward or drawn end portion, of the feed tray which is drawn midway from the image recording apparatus, is lifted upward to thereby release the above-described holding and to allow the feed tray to be removed from the image recording apparatus.

SUMMARY

The above-described image recording apparatus requires, in the inside of the image recording apparatus, a space for arranging or locating the lifted feed tray therein. However, the provision of such a space results in an increased size of the image recording apparatus.

As a means for providing the above-described space while maintaining the size of the image recording apparatus as it is, it is conceived to decrease the thickness in the up/down direction of the feed tray. The thinning of the thickness of the feed tray, however, results in the lowered rigidity of the feed tray.

The present teaching is made in view of the above problem, and an object of the present teaching is to provide a configuration capable of maintaining at least a portion of a feed tray in an apparatus in which the feed tray is installed, while suppressing the size of the apparatus from becoming large and maintaining the rigidity of the feed tray to be high.

According to an aspect of the present teaching, there is provided a conveying apparatus configured to convey a sheet, including:

a main body formed with a conveyance path via which the sheet is conveyed;

a first feed tray which is installable in the main body at a first position by being inserted with respect to (into) the main body toward one side in a first direction, crossing an up/down direction, through an opening formed in the main body, which is removable with respect to (from) the main body toward the other side in the first direction, and which is configured to support the sheet to be fed to the conveyance path;

a discharge tray which is arranged at a location above the first feed tray in a state of being located at the first position and which is configured to support the sheet discharged from the conveyance path; and a first regulating section configured to perform regulation for regulating movement, toward the other side in the first direction, of the first feed tray in a state of being located at a second position, wherein the second position is a position same as the first position or a position away from the first position toward the other side in the first direction;

the first regulating section is configured to release the regulation, in a case that the first feed tray, in the state of being located at the second position, is moved upwardly by a first predetermined moving amount;

a spacing distance in the up/down direction between the first feed tray and the discharge tray is shorter than the first predetermined moving amount; and the discharge tray is configured to move upwardly by being contacted with the first feed tray in a case that the first feed tray is moved upwardly.

According to this configuration, in a case that the regulation by the first regulating section is released, the first feed tray can move to a space at which the discharge tray has been present previously. Namely, according to the configuration, the space which is configured to allow the discharge tray to be present therein and the space which is configured to allow the first feed tray to move thereinto can be made common. With this configuration, it is possible to suppress the size of the conveying apparatus from becoming large. Further, also with this configuration, there is no need to reduce the thickness in the up/down direction of the first feed tray, and thus the rigidity of the first feed tray can be maintained to be high.

According to the conveying apparatus according to the present teaching, it is possible to maintain the first feed tray at the second position while suppressing the size of the conveying apparatus from becoming large and maintaining the rigidity of the first feed tray to be high.

BRIEF DESCRIPTION OF THE DRAWINGS

FIGS. 3A and 3B are each a perspective view depicting a lower portion of a printer casing 14, wherein FIG. 3A depicts a state that a first feed tray 21 is installed and a second feed tray 22 is removed, and FIG. 3B depicts a state that the second feed tray 22 is installed and the first feed tray 21 is removed.

DESCRIPTION OF THE EMBODIMENT

Figure 1:
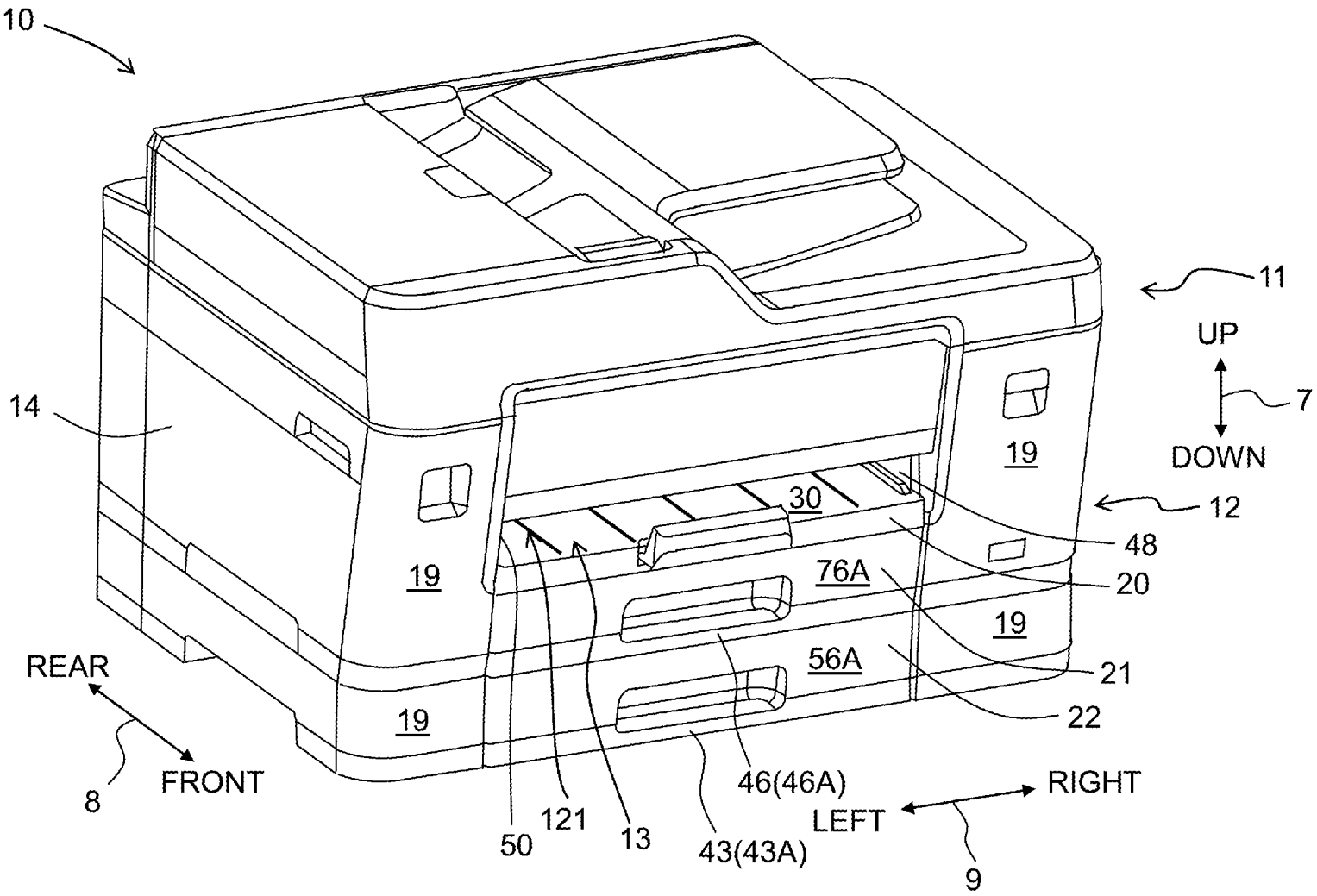
FIG. 1 is a perspective view of a multi-function peripheral 10.

In the following, an embodiment of the present teaching will be explained. It is needless to say that the embodiment to be explained below is merely an example of the present teaching, and that it is possible to appropriately change the embodiment of the present teaching without departing from the gist and scope of the present teaching. In the following explanation, an up/down direction 7 is defined with a state that a multi-function peripheral 10 is usably placed (usable state; state depicted in FIG. 1), as the reference; a front/rear direction 8 is defined such that a surface on which an opening 13 of the multi-function peripheral 10 is provided is the frontward surface (front surface or front side) 19; and a left/right direction 9 is defined as viewing the multi-function peripheral 10 from the front surface 19. The up/down direction 7, the front/rear direction 8 and the left/right direction 9 are orthogonal to one another.

Further, in the following explanation, in a case that the configurations of a first feed tray 21 and a second feed tray 22 are explained, the respective directions as described above are each indicated, provided that the first feed tray 21 and the second feed tray 22 are each in a state of being installed in a printer casing 14 of the multi-function peripheral 10.

<Overall Structure of Multi-Function Peripheral 10>

As depicted in FIG. 1, the multi-function peripheral 10 is formed to have a substantially rectangular parallelepiped shape. The multi-function peripheral 10 includes a scanner section 11 which is provided on an upper portion thereof and which allows an image sensor to read an image recorded on a manuscript (original) so as to acquire image data of the read image, and a printer section 12 (an example of an image recording apparatus) which is provided on a lower portion of the multi-function peripheral 10 and which is configured to record an image on paper 15 (paper sheet or sheet 15; see FIG. 2) based on the above-described image data, etc.

Although the scanner section 11 is configured as a so-called flatbed scanner, any detailed explanation of the internal configuration of the scanner section 11 will be omitted in the following explanation.

Figure 2:
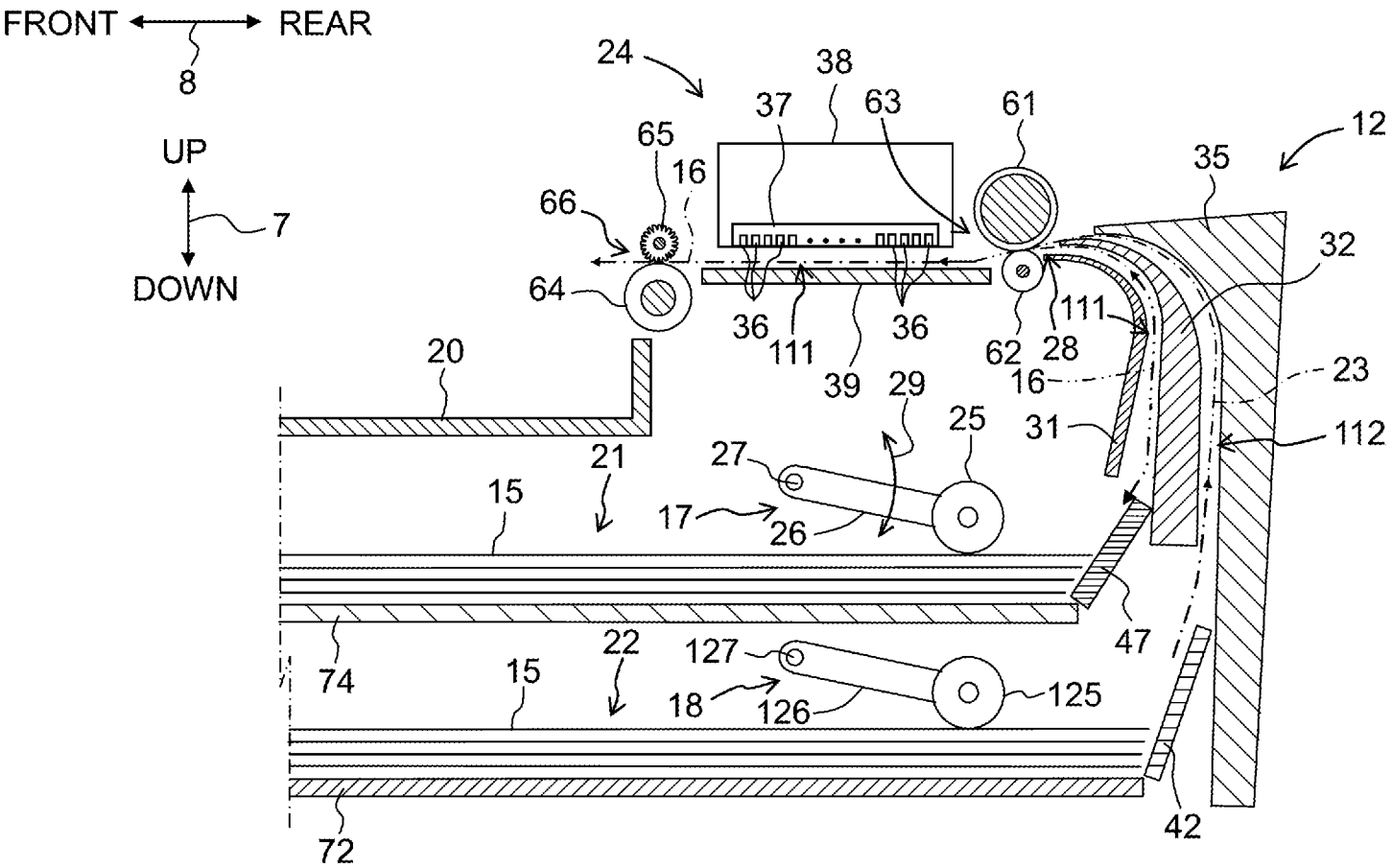
FIG. 2 is a vertical cross-sectional view schematically depicting the internal structure of a printer section 12.

As depicted in FIG. 2, the printer section 12 is provided with a conveying apparatus and a recording section 24. The conveying apparatus is provided with the printer casing 14 (an example of a main body or body; see FIG. 1), the first feed tray 21, the second feed tray 22; a discharge tray 20, a first feeding section 17, a second feeding section 18, a conveying roller pair 63, and a discharging roller pair 66.

As depicted in FIG. 1, the printer casing 14 is formed to have a substantially rectangular parallelepiped shape, and is formed with the opening 13 in the front surface 19. A first conveyance path 111 and a second conveyance path 112 are formed in the inside of the printer casing 14 (see FIG. 2), and the sheet 15 (an example of a sheet) is conveyed along the first and second conveyance paths 111 and 112. The first and second conveyance paths 111 and 112 are each an example of a conveyance path.

As depicted in FIG. 2, the first feed tray 21 supports a sheet 15 to be fed to the first conveyance path 111; the second feed tray 22 supports a sheet 15 to be fed to the second conveyance path 112. The discharge tray 20 supports the sheet 15 discharged from the first conveyance path 111. The first feeding section 17 feeds the sheet 15 supported by the first feed tray 21 to the first conveyance path 111. The second feeding section 18 feeds the sheet 15 supported by the second feed tray 22 to the second conveyance path 112. The conveying roller pair 63 and the discharging roller pair 66 convey the sheet 15 along the first conveyance path 111. The recording section 24 records an image on the sheet 15 conveyed in (via) the first conveyance path 111.

The conveying roller pair 63, the discharging roller pair 66, and the recording section 24 are arranged inside the printer casing 14.

Figure 6:
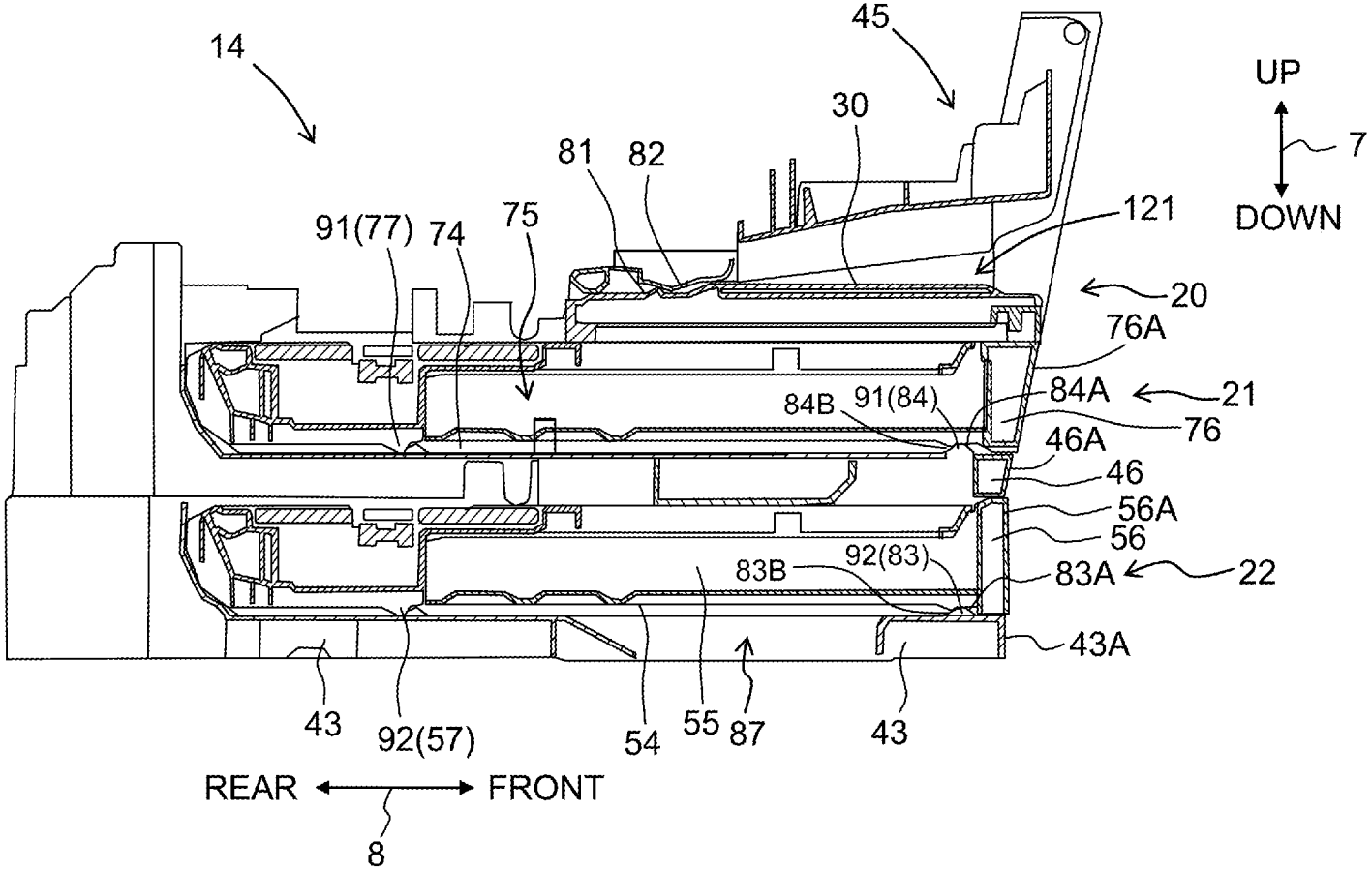
FIG. 6 is a vertical cross-sectional view of the lower portion of the printer casing 14, depicting a state that the first feed tray 21 is located at a first position and that the second feed tray 22 is located at a third position.

As depicted in FIG. 1, the first feed tray 21 and the second feed tray 22 are inserted into the printer casing 14 via the opening 13 and installed in the printer casing 14, as depicted in FIGS. 1 and 6, by being moved rearwardly (an example of one side in a first direction, and one side in a second direction), via the opening 13, with respect to the printer casing 14. The position at which the first feed tray 21 is in a state that the first feed tray 21 is installed in the printer casing 14 (the state depicted in FIG. 6) is a first position. The position at which the second feed tray 22 is in a state that the second feed tray 22 is installed in the printer casing 14 (the state depicted in FIG. 6) is a third position.

Further, the first feed tray 21 and the second feed tray 22 are removed (detached) from the printer casing 14 via the opening 13, by being moved via the opening 13 frontwardly (an example of the other side in the first direction, and the other side in the second direction) with respect to the printer casing 14. The discharge tray 20 is supported by the printer casing 14. As will be described later on, the discharge tray 20 is removable (detachable) from the printer casing 14 by in a case that the discharge tray 20 is rotated by a predetermined rotating amount.

[First Feeding Section 17 and Second Feeding Section 18]

As depicted in FIG. 2, the first feeding section 17 is arranged at a location below the recording section 24. The first feeding section 17 includes a feeding roller 25, a feeding arm 26, a driving force transmitting mechanism (not depicted in the drawings), and a shaft 27. The feeding roller 25 is supported to be rotatable at a forward end portion of the feeding arm 26. The feeding arm 26 is rotated about the shaft 27, which is provided at a basal end portion thereof as the rotating center, in directions indicated by a double-sided arrow 29. This allows the feeding roller 25 to be capable of making contact with and separating from the first feed tray 21 or the sheet(s) 15 supported by the first feed tray 21.

The feeding roller 25 is rotated by being imparted with a driving force from a feeding motor (not depicted in the drawings) via the driving force transmitting mechanism which is constructed of a plurality of gears meshing with each other. With this, an uppermost sheet 15, among the sheets 15 supported by a bottom plate 74 of the first feed tray 21 is picked up by the feeding roller 25 which is rotating, and is conveyed rearwardly. Note that in a case that the number of the sheet 15 supported by the bottom plate 74 is 1 (one) sheet, the feeding roller 25 picks up the one sheet 15 and feeds the one sheet 15 rearwardly. The conveyed sheet 15 is guided by an inclined plate 47 provided on the printer casing 14 and is thus fed to the first conveyance path 111. Note that the driving force transmitting mechanism is not limited to the aspect constructed of the plurality of gears meshing with each other, and may be, for example, a belt suspended between the shaft 27 and the shaft of the feeding roller 25.

The second feeding section 18 is arranged at a location below the first feeding section 17. The second feeding section 18 has a configuration similar to that of the first feeding section 17, and includes a feeding roller 125, a feeding arm 126, a driving force transmitting mechanism (not depicted in the drawings), and a shaft 127. By the rotation of the feeding roller 125, an uppermost sheet 15, among the sheets 15 supported by a bottom plate 72 of the second feed tray 22 is picked up by the feeding roller 125 which is rotating, and is conveyed rearwardly. Note that in a case that the number of the sheet 15 supported by the bottom plate 72 is 1 (one) sheet, the feeding roller 125 picks up the one sheet 15 and feeds the one sheet 15 rearwardly. The conveyed sheet 15 is guided by an inclined plate 42 provided on the printer casing 14 and is thus fed to the second conveyance path 112. The second feeding section 18 has a configuration similar to that of the first feeding section 17.

[First Conveyance Path 111 and Second Conveyance Path 112]

The first conveyance path 111 is a path via which the sheet 15 is conveyed. As depicted in FIG. 2, with a rear end portion of the first feed tray 21, which is in a state of being located at the first position, as the base point, the first conveyance path 111 extends upwardly, then makes a U-turn frontwardly from the rear side, and then extends frontwardly up to the discharge tray 20. The first conveyance path 111 is defined by a first guide member 31 and a second guide member 32 which face each other with a predetermined spacing distance therebetween, the conveying roller pair 63, the recording section 24 and a platen 39 which face each other with a predetermined spacing distance therebetween, and the discharging roller pair 66. Note that the platen 39 is a member configured to support the sheet 15. The sheet 15 is conveyed in (via) the first conveyance path 111 in a conveyance direction 16 indicated by dash-dot line arrows in FIG. 2.

The second conveyance path 112 is a path via which the sheet 15 is conveyed. As depicted in FIG. 2, the second conveyance path 112 is positioned on the rear side of a curved portion of the first conveyance path 111. With a rear end portion of the second feed tray 22, which is in a state of being located at the third position, as the base point, the second conveyance path 112 extends upwardly, then makes a U-turn frontwardly from the rear side, and then extends frontwardly and joins the first conveyance path 111 at a joining position 28. The second conveyance path 112 is defined by the second guide member 32 and a third guide member 33 facing each other with a predetermined spacing distance therebetween. The sheet 15 is conveyed in (via) the second conveyance path 112 in a conveyance direction 23 indicated by dot-dot-dash line arrows in FIG. 2.

<Conveying Roller Pair 63 and Discharging Roller Pair 66>

As depicted in FIG. 2, the conveying roller pair 63, including a conveyance roller 61 and a pinch roller 62, is arranged in the first conveyance path 111 on the downstream side in the conveyance direction 16 relative to the joint position 28. The pinch roller 62 is pressed against the roller surface of the conveyance roller 61 by an elastic member (not shown) such as a spring, etc. The discharging roller pair 66, including a discharge roller 64 and a spur 65, is arranged in the first conveyance path 111 on the downstream side in the conveyance direction 16 relative to the conveying roller pair 63. The spur 65 is pressed against the roller surface of the discharge roller 64 by an elastic member (not shown) such as a spring, etc. Each of the conveyance roller 61 and the discharge roller 64 is rotated by a driving force transmitted thereto from a conveyance motor (not shown) to convey the paper 15 in the conveyance direction 16 while nipping the paper 15 between itself and the pinch roller 62 or the spur 65.

[Recording Section 24]

As depicted in FIG. 2, the recording section 24 is arranged between the conveying roller pair 63 and the discharging roller pair 66 in the first conveyance path 111. The recording section 24 is arranged at a location above the platen 39 to face (to be opposite to) the platen 39. The recording section 24 includes a recording head 37 and a carriage 38 on which the recording head 37 is mounted. The recording head 37 is formed with a plurality of nozzles 36 from which an ink supplied from an ink cartridge (not shown) is discharged (jetted) toward the platen 39. The carriage 38 is configured to be movable in the left/right direction 9. Droplets of the ink (ink droplets) are discharged or jetted from the nozzles 36 toward a sheet 15 supported on (by) the platen 39, while the carriage 38 is moving in the left/right direction 9. With this, an image is recorded on the sheet 15. Further, in this embodiment, the ink-jet recording system is adopted as a system by which the recording section 24 records the image on the sheet 15. Note that, however, there is no limitation to this. The image recording system may be, for example, the electro-photographic system, etc.

<Printer Casing 14>

As depicted in FIG. 1, the printer casing 14 is formed to have a substantially rectangular parallelepiped shape. The opening 13 is formed on the front surface 19 of the printer casing 14. The printer casing 14 have an internal space 121 formed therein. The internal space 121 is communicated with the outside of the printer casing 14 via the opening 13.

Figure 3A:
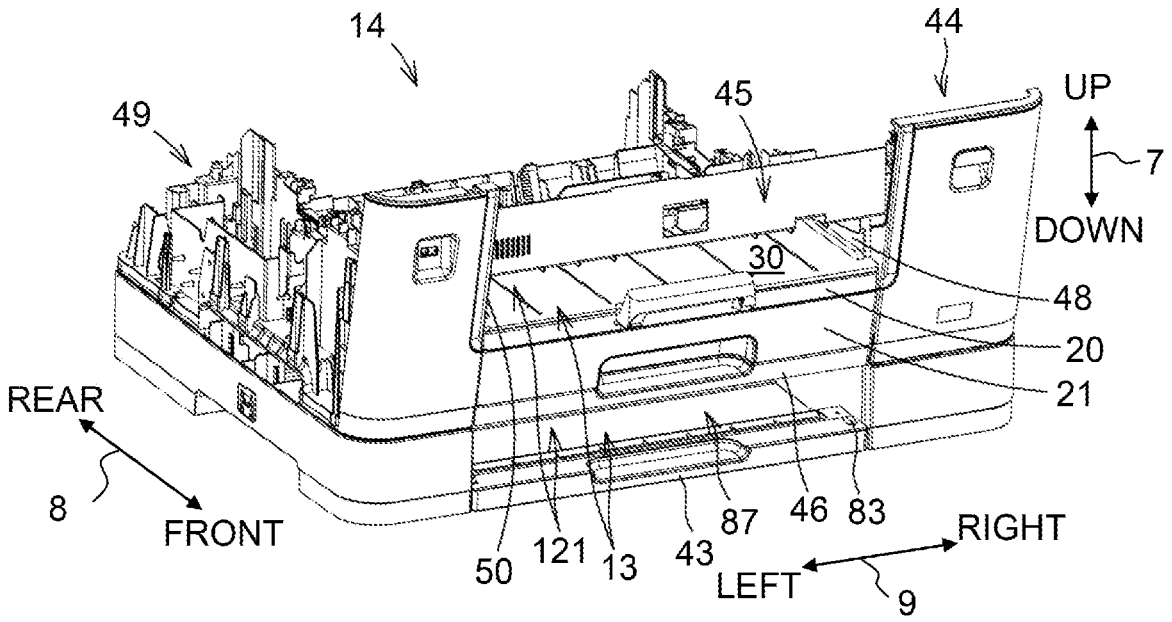
Figure 3B:
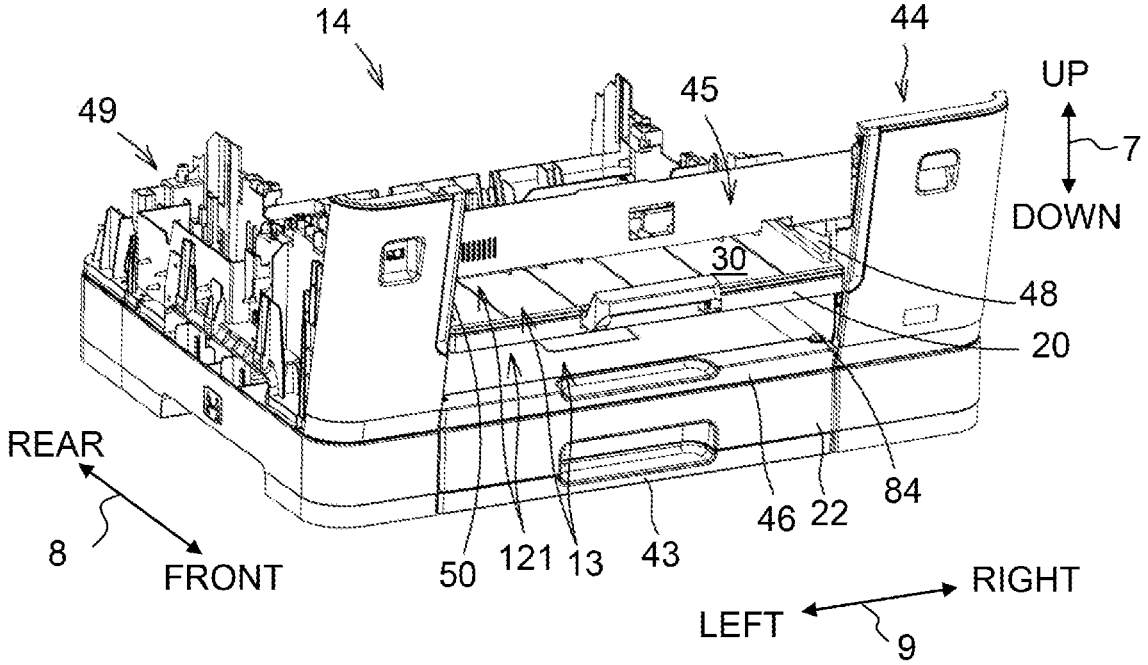

As depicted in FIGS. 3A and 3B, the printer casing 14 is provided with a bottom portion 43 (an example of a second supporting wall), a right portion 44, a left portion 49, an upper portion 45 and a supporting plate 46 (an example of a first supporting wall).

As depicted in FIG. 3B, the bottom portion 43 is formed to have a plate-like shape. The bottom portion 43 expands in the front/rear direction 8 and the left/right direction 9, and the thickness direction of the bottom portion 43 coincides with the up/down direction 7. As depicted in FIG. 1, a front surface 43A of the bottom portion 43 is in a same surface with the front surface 19. The bottom portion 43 defines or demarcates a lower portion of the internal space 121. The bottom portion 43 supports the second feed tray 22 located in the inside of the printer casing 14.

Figure 4:
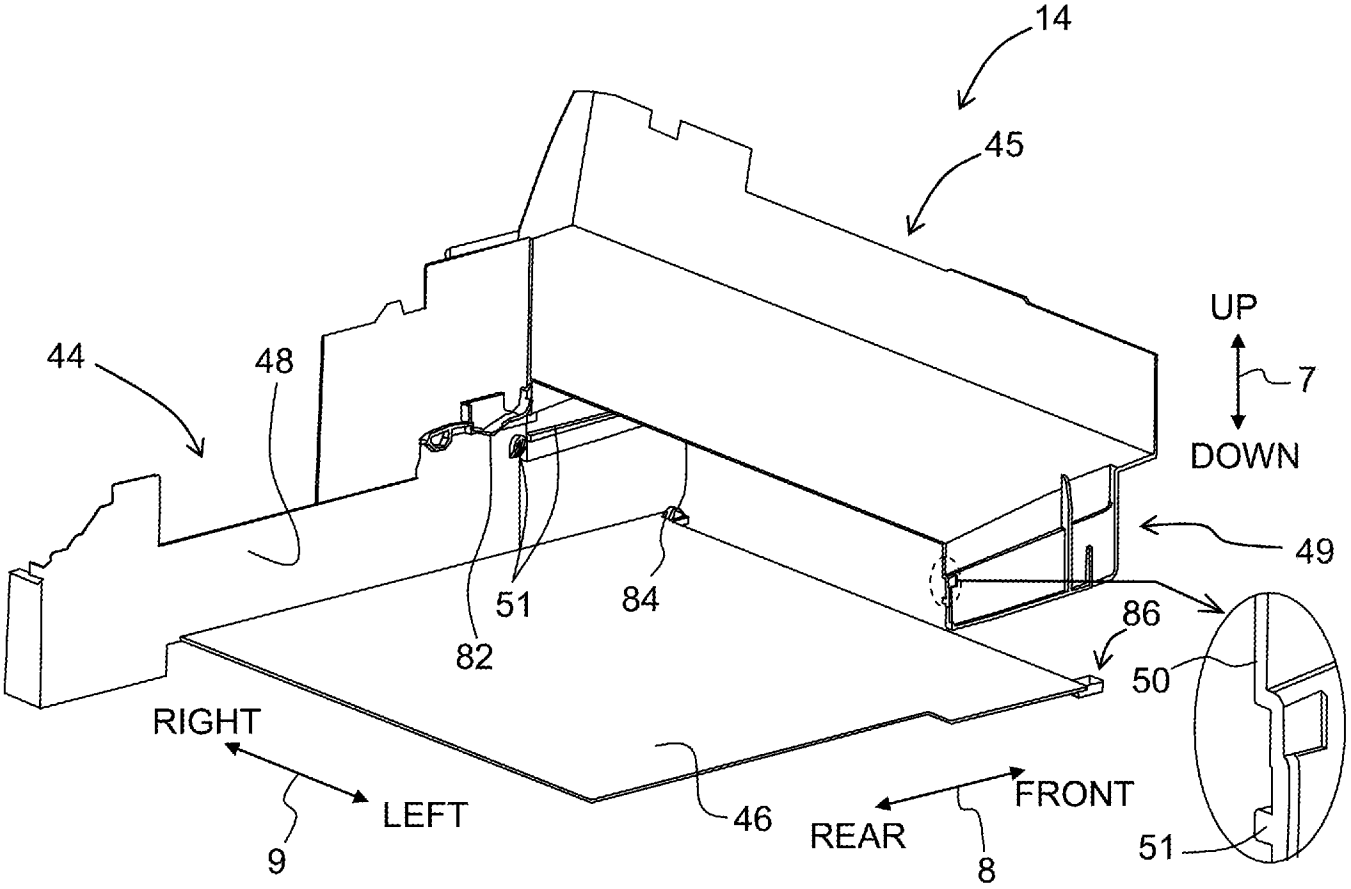
FIG. 4 is a perspective view schematically depicting the lower portion of the printer casing 14.

As depicted in FIGS. 3A and 3B, the right portion 44 is provided upstandingly and upwardly at a right end portion of the bottom portion 43, and the left portion 49 is provided upstandingly and upwardly at a left end portion of the bottom portion 43. As depicted in FIGS. 3A, 3B and 4, the right portion 44 is provided with a side surface 48 oriented (facing) leftward. The side surface 48 defines a right portion of the internal space 121. The left portion 49 is provided with a side surface 50 oriented rightward. The side surface 50 defines a left portion of the internal space 121. Note that FIG. 4 depicts only a part or portion of the left portion 49, and remaining portion of the left portion 49 is omitted in the drawings.

The upper portion 45 is arranged so as to link or connect a front upper portion of the right portion 44 and a front upper portion of the left portion 49. The upper portion 45 defines an upper portion of the internal space 121.

As depicted in FIG. 3A, the supporting plate 46 is formed to have a plate-like shape. The supporting plate 46 expands in the front/rear direction 8 and the left/right direction 9, and the thickness direction of the supporting plate 46 coincides with the up/down direction 7. As depicted in FIG. 1, a front surface 46A of the supporting plate 46 is in a same surface with the front surface 19. As depicted in FIGS. 3A and 3B, the supporting plate 46 is arranged so as to link or connect a central portion in the up/down direction 7 of the right portion 44 and a central portion in the up/down direction 7 of the left portion 49. Namely, the supporting plate 46 is arranged at a location above the bottom portion 43. The supporting plate 46 divides the internal space 121 into two portions. The discharge tray 20 and the first feed tray 21 are inserted to an upper portion of the internal space 121 divided into the two portions. The second feed tray 22 is inserted to a lower portion of the internal space 121 divided into the two portions. The supporting plate 46 supports the first feed tray 21 in a state of being located inside the printer casing 14.

As depicted in FIG. 4, a supporting portion 51 and a contacting portion 82 are provided on each of the side surfaces 48 and 50. The supporting portion 51 and the contacting portion 82 provided on the side surface 48 are projected leftwardly from the side surface 48, and the supporting portion 51 and the contacting portion 82 provided on the side surface 50 are projected rightwardly from the side surface 50. The supporting portions 51 and the contacting portions 82 are formed at a location above the first feed tray 21 which is located at the first position.

Each of the supporting portions 51 is provided to extend in the front/rear direction 8. The supporting portions 51 support the discharge tray 20 to be movable in the front/rear direction 8, and to be rotatable (to be described later on). The supporting portion 51 projected from the side surface 48 supports a right end portion of the discharge tray 20 from therebelow. The supporting portion 51 projected from the side surface 50 supports a left end portion of the discharge tray 20 from therebelow. The supporting portions 51 do not support a rear portion of the discharge tray 20.

Each of the contacting portions 82 is arranged at a location rearward and upward with respect to one of the supporting portions 51 corresponding thereto. The contacting portions 82 make contact with the discharge tray 20 from thereabove. In a state that the discharge tray 20 is installed in the printer casing 14, each of the contacting portions 82 is engaged with one of projecting portions 81 provided on an upper surface 30 of the discharge tray 20, as depicted in FIG. 6. With this, the frontward withdrawal of the discharge tray 20 is regulated (restricted).

Figure 7:
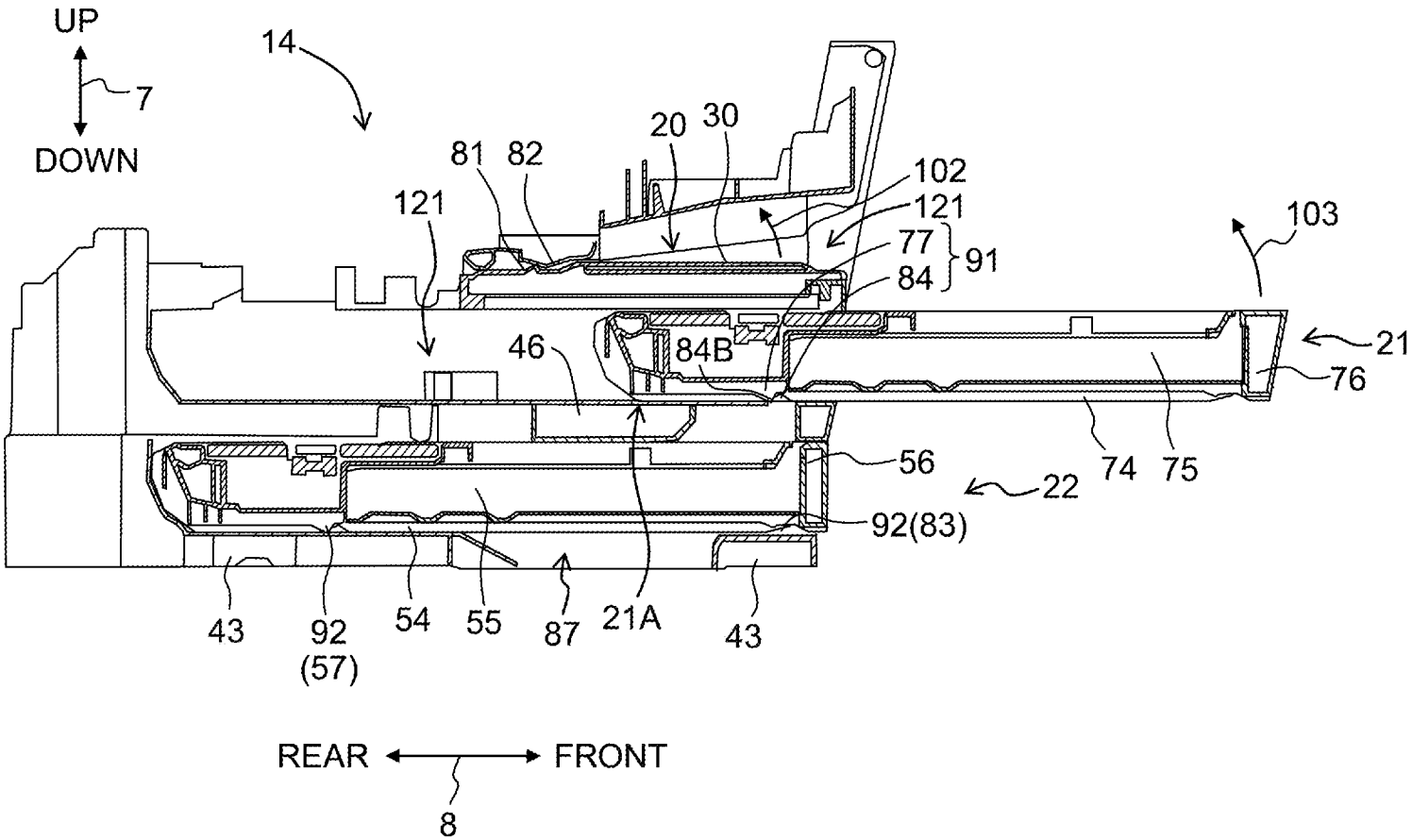
FIG. 7 is a vertical cross-sectional view of the lower portion of the printer casing 14, depicting a state that the first feed tray 21 is located at a second position and that the second feed tray 22 is located at the third position.

As depicted in FIGS. 3B, 4 and 6, the supporting plate 46 is provided with a contacting portion 84. The contacting portion 84 is formed as contacting portions 84 provided respectively on left and right end portions in a front end portion of the supporting plate 46. Each of the contacting portions 84 is fitted into a recessed portion 86 (see FIG. 4) formed in one of the left and right end portions in the front end portion of the supporting plate 46. Each of the contacting portions 84 is formed of a material of which modulus of elasticity is smaller than that of the supporting plate 46. The contacting portions 84 are projected upwardly from the supporting plate 46. The upper surface of each of the contacting portions 84 is warped (bent) so as to project upwardly. In a process in which the first feed tray 21 is inserted to the printer casing 14, each of projecting portions 77 provided on the first feed tray 21 (to be described later on) makes contact with a surface 84A, of one of the contacting portions 84, which faces (is oriented) frontward, from the front side of the surface 84A. On the other hand, in a process in which the first feed tray 21 is removed from the printer casing 14, each of projecting portions 77 makes contact with a surface 84B, of one of the contacting portions 84, which faces rearward, from the rear side of the surface 84A, as depicted in FIG. 7. Note that the contacting portions 84 may be formed integrally with the supporting plate 46.

As depicted in FIGS. 3A and 6, the bottom portion 43 is provided with a contacting portion 83 and a recessed portion 87.

Figure 9:
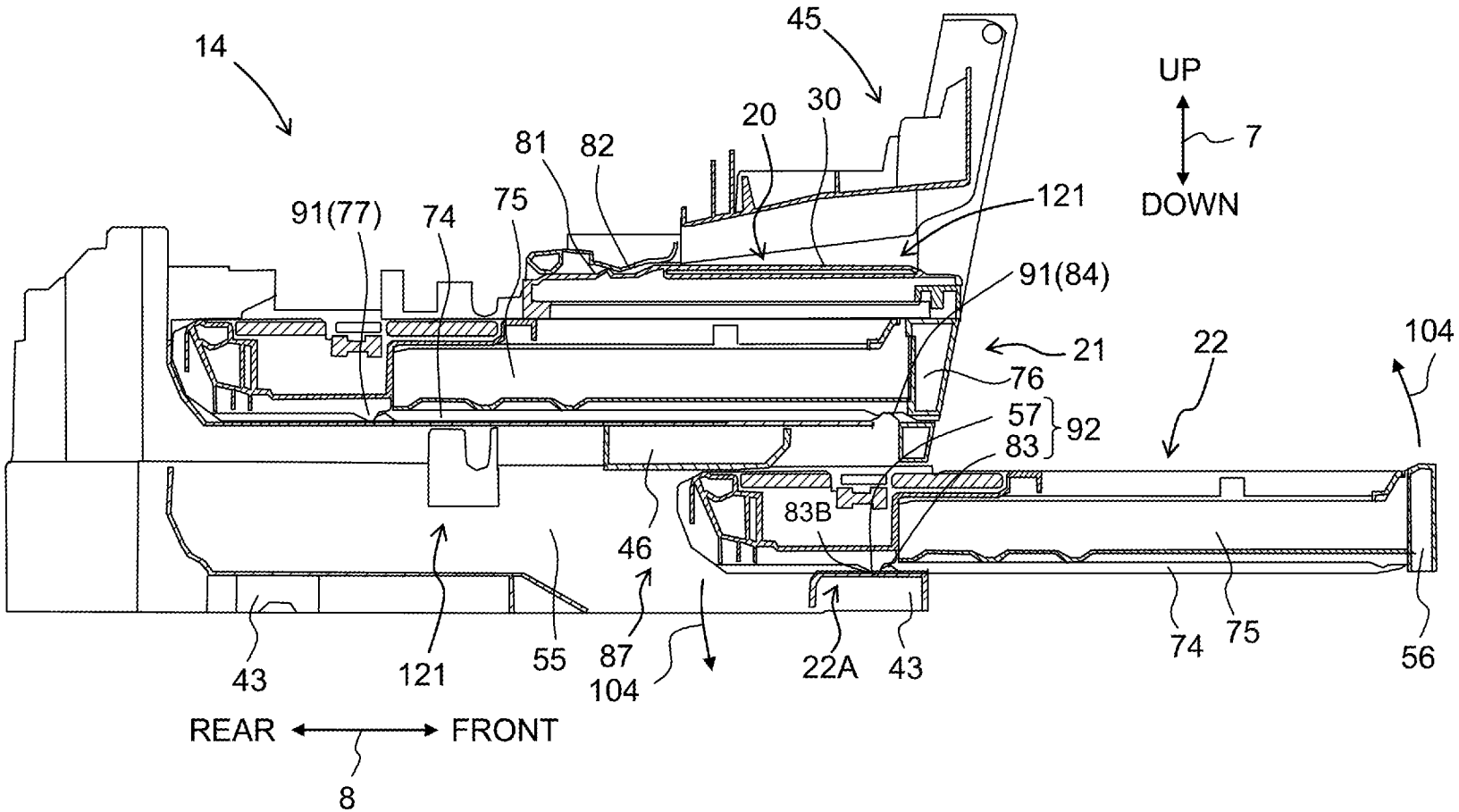
FIG. 9 is a vertical cross-sectional view of the lower portion of the printer casing 14, depicting a state that the first feed tray 21 is located at the first position and that the second feed tray 22 is located at a fourth position.

The contacting portion 83 is formed as contacting portions 83 provided respectively on left and right end portions in a front end portion of the bottom portion 43. Each of the contacting portions 83 is fitted into a recessed portion (not depicted in the drawings) formed in one of the left and right end portions in the front end portion of the bottom portion 43. Each of the contacting portions 83 is formed of a material of which modulus of elasticity is smaller than that of the bottom portion 43. The contacting portions 83 are projected upwardly from the bottom portion 43. The upper surface of each of the contacting portions 83 is warped or bent so as to project upwardly. In a process in which the second feed tray 22 is inserted to the printer casing 14, each of projecting portions 57 provided on the second feed tray 22 (to be described later on) makes contact with a surface 83A, of one of the contacting portions 83, which faces frontward, from the front side of the surface 83A. On the other hand, in a process in which the second feed tray 22 is removed from the printer casing 14, each of projecting portions 57 makes contact with a surface 83B, of one of the contacting portions 83, which faces rearward, from the rear side of the surface 83A, as depicted in FIG. 9. Note that the contacting portions 83 may be formed integrally with the bottom portion 43.

The recessed portion 87 is a recess formed in the upper surface of the bottom portion 43. The recessed portion 87 is positioned on the rear side of the contacting portion 83. The recessed portion 87 is provided to span across the right end portion to the left end portion of the bottom portion 43. Namely, the length in the left/right direction 9 of the recessed portion 87 is longer than the length in the left/right direction 9 of the second feed tray 22. In a case that the second feed tray 22 is located at a fourth position (to be described later on; the position of the second feed tray 22 depicted in FIG. 9), a rear end portion of the recessed portion 87 is positioned on the rear side of the second feed tray 22 located at the fourth position.

<First Feed Tray 21 and Second Feed Tray 22>

Each of the first feed tray 21 and the second feed tray 22 is integrally formed of a resin such as polystyrene (PS). In this embodiment, each of the first feed tray 21 and the second feed tray 22 is integrally formed of a High Impact Polystyrene (HIPS). Note that the above described resins forming the first and second feed trays 21 and 22, respectively, are merely examples; it is allowable that each of the first and second feed trays 21 and 22 is formed of a resin which is different from the High Impact Polystyrene. Alternatively, it is allowable that the first feed tray 21 or the second feed tray 22 is not formed integrally.

Figure 5A:
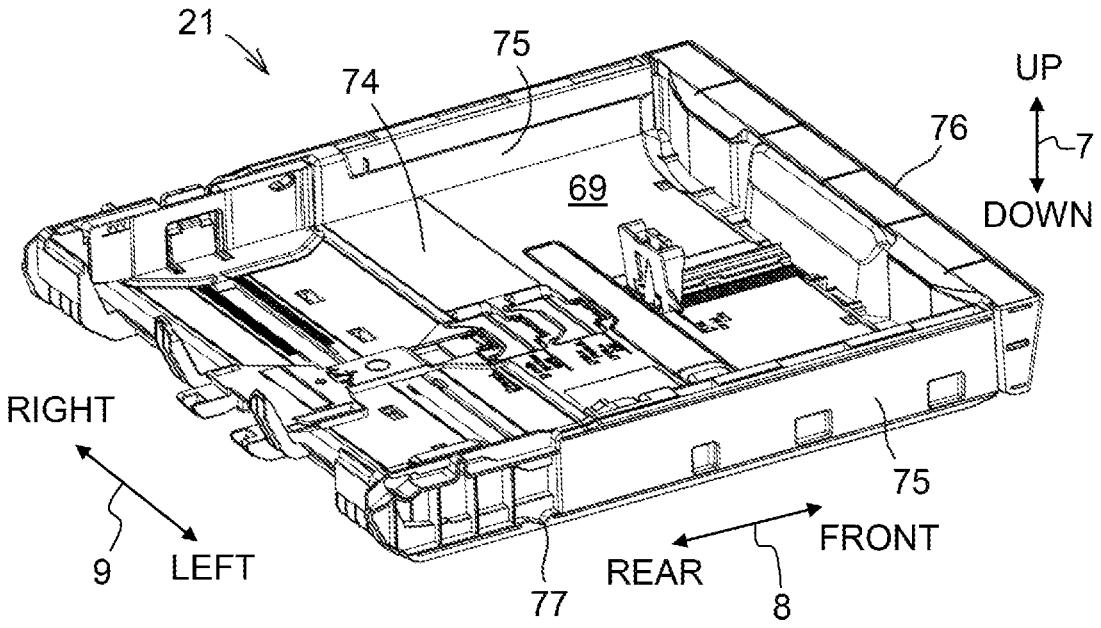
FIG. 5A is a perspective view of the first feed tray 21.

As depicted in FIG. 5A, the first feed tray 21 is provided with: a bottom plate 74 (an example of a first bottom wall) having an upper surface 69 (an example of a sheet supporting surface) configured to support the sheet 15; a pair of side plates 75 (an example of a pair of first side walls) which are provided upstandingly and upwardly at both of left and right end portions, of the bottom plate 74, in the left/right direction 9 orthogonal to the front/rear direction 8 and along the upper surfaced 69 of the bottom plate 74; and a front plate 76 (an example of a first upstanding wall) provided upstandingly and upwardly at a front end portion of the bottom plate 74. Upper end portions of the pair of side plates 75 are located at a height substantially same as that of an upper end portion of the front plate 76. As depicted in FIG. 1, a front surface 76A of the first feed tray 21 in the state of being located at the first position is in a same surface with the front surface 19 of the printer casing 14.

As depicted in FIG. 5A, a projecting portion 77 (an example of a projecting portion) is formed in each of the pair of side plates 75. The projecting portion 77 is formed as projecting portions 77 provided respectively on a lower portion of a side plate 75, included in the pair of side plates 75, provided on the right end portion of the bottom plate 74 and on a lower portion of a side plate 75, which is included in the pair of side plates 75 and which is provided on the left end portion of the bottom plate 74. Each of the projecting portions 77 is projected downwardly from one of the lower portions of the side plates 75 provided on the left and right end portions of the bottom plate 74. The projecting portions 77 make contact with the contacting portions 84, respectively, in a process in which the first feed tray 21 is (being) inserted or removed with respect to the printer casing 14. Note that the positions in the front/rear direction 8 of the projecting portions 77 are not limited to those depicted in FIG. 5A. For example, the projecting portions 77 may be formed on a front end portion or a rear end portion of the pair of side plates 75.

Figure 5B:
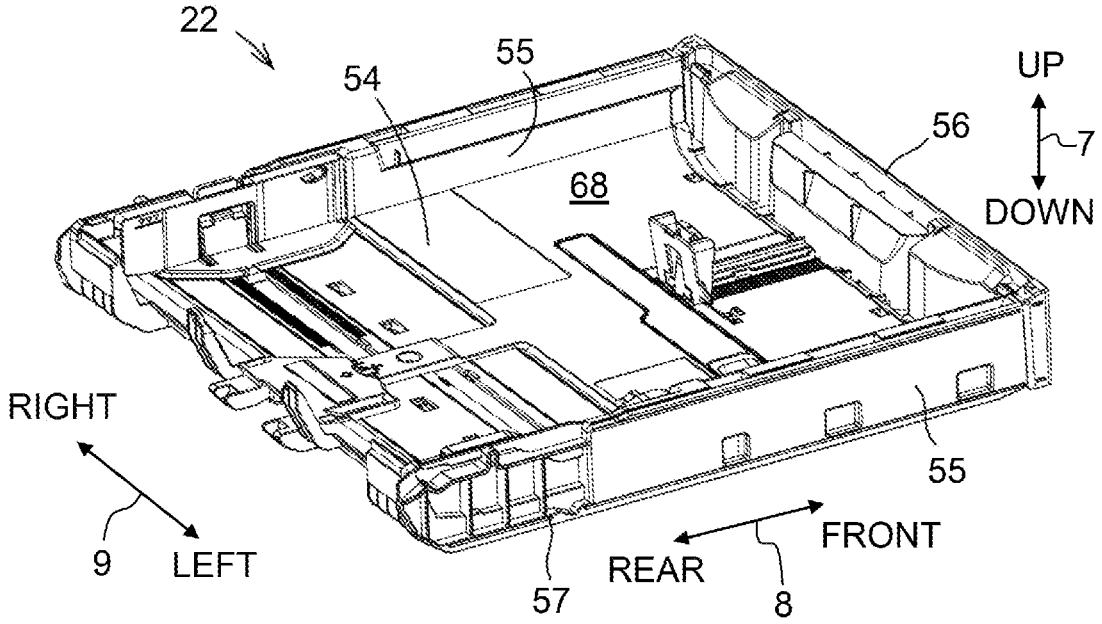
FIG. 5B is a perspective view of the second feed tray 22.

As depicted in FIG. 5B, the second feed tray 22 is provided with: a bottom plate 54 (an example of a second bottom wall) having an upper surface 68 (an example of a sheet supporting surface) configured to support the sheet 15; a pair of side plates 55 (an example of a pair of second side walls) which are provided upstandingly and upwardly at both of left and right end portions, of the bottom plate 54, in the left/right direction 9 orthogonal to the front/rear direction 8 and along the upper surfaced 68 of the bottom plate 54; and a front plate 56 (an example of a second upstanding wall) provided upstandingly and upwardly at a front end portion of the bottom plate 54. Upper end portions of the pair of side plates 55 are located at a height substantially same as that of an upper end portion of the front plate 56. As depicted in FIG. 1, a front surface 56A of the second feed tray 22 in the state of being located at the third position is in a same surface with the front surface 19 of the printer casing 14.

As depicted in FIG. 5B, a projecting portion 57 (an example of a projecting portion) is formed in each of the pair of side plates 55. The projecting portion 57 is formed as projection portions 57 provided respectively on a lower portion of a side plate 55 which is included in the pair of side plates 55 and which is provided on the right end portion of the bottom plate 54, and on a lower portion of a side plate 55 which is included in the pair of side plates 55 and which is provided on the left end portion of the bottom plate 74. Each of the projecting portions 57 is projected downwardly from one of the lower portions of the side plates 55 provided on the left and right end portions of the bottom plate 54. The projecting portions 57 make contact with the contacting portions 83, respectively, in a process in which the second feed tray 22 is inserted or removed with respect to the printer casing 14. Note that the positions in the front/rear direction 8 of the projecting portions 57 are not limited to those depicted in FIG. 5B. For example, the projecting portions 57 may be formed on a front end portion or a rear end portion of the pair of side plates 55.

[The Discharge Tray 20]

As shown in FIG. 6, the discharge tray 20 is arranged at a location above the first feed tray 21 in the state of being located at the first position. The discharge tray 20 is a substantially plate-shaped member spanning in the front/rear direction 8 and the left/right direction 9. The discharge tray 20 has an upper surface 30 which is provided with a projection 81. The projection 81 is formed as projections 81 provided respectively on left and right end portions on a rear portion of the upper surface 30. The projecting portions 81 are capable of engaging with the contacting portions 82 provided on the side surfaces 48 and 50 of the printer casing 14, respectively.

Frontward movement of the discharge tray 20 is regulated by engagement of the projecting portions 81 with the contacting portions 82. However, the discharge tray 20 is rotatable, as will be described later on. Further, in a case that the discharge tray 20 is rotated by an amount not less than a predetermined rotating amount, this rotation of the discharge tray 20 causes the projecting portions 81 to move to a location below with respect to (lower than) the contacting portions 82, thus no longer regulating the forward movement of the discharge tray 20, thereby causing the discharge tray 20 to be movable frontwardly (see FIG. 8). This allows the discharge tray 20 to be removable from the printer casing 14.

The configuration allowing the discharge tray 20 to be rotatable is as follows. Namely, in a state that the discharge tray 20 is supported by the supporting portions 51 of the printer casing 14, the discharge tray 20 is rotatable in a direction indicated by an arrow 102 in FIG. 7 about contact locations (contact portions), of the discharge tray 20, making contact respectively with the rear end portions of the support portions 51 as the fulcrum, such that another portion of the discharge tray 20 located away from the fulcrum in the front direction is moved upwardly and still another portion of the discharge tray 20 located away from the fulcrum in the rear direction is moved downwardly. Note that, however, in a case that the first feed tray 21 is positioned at a location below the rear portion of the discharge tray 20 (in a case that the state depicted in FIG. 6 is provided), the still another portion of the discharge tray 20 located on the rear side of the fulcrum cannot move downwardly by being prevented from the first feed tray 20, and thus the discharge tray 20 cannot rotate in this state.

<First Regulating Section 91 and Second Regulating Section 92>

In a case that the first feed tray 21 located at the first position (the position of the first feed tray 21 depicted in FIG. 6) is moved frontward to be located at the second position (the position of the first feed tray 21 depicted in FIG. 7) which is positioned on the front side of the first position, a first regulating section 91 is configured to regulate the frontward movement of the first feed tray 21 in a state of being located at the second position.

The first regulating section 91 is provided with the projecting portions 77 provided on the first feed tray 21 and the contacting portions 84 provided on the supporting plate 46 of the printer casing 14. As depicted in FIG. 7, in a case that the first feed tray 21, which is moved frontwardly from the first position, reaches the second position, each of the projecting portions 77 makes contact with the surface 84B of one of the contacting portions 84. This regulates the frontward movement, of the first feed tray 21, from the second position.

In a case that the second feed tray 22 located at the third position (the position of the second feed tray 22 depicted in FIG. 6) is moved frontward to be located at the fourth position (the position of the second feed tray 22 depicted in FIG. 7) which is positioned on the front side of the third position, a second regulating section 92 is configured to regulate the frontward movement of the second feed tray 22 in a state of being located at the fourth position, namely to regulate the movement of the second feed tray 22 in a direction in which the second feed tray 22 is removed from the printer casing 14.

The second regulating section 92 is provided with the projecting portions 57 provided on the second feed tray 22 and the contacting portions 83 provided on the bottom portion 43 of the printer casing 14. As depicted in FIG. 9, in a case that the second feed tray 22, which is moved frontwardly from the third position, reaches the fourth position, each of the projecting portions 57 makes contact with the surface 83B of one of the contacting portions 83. This regulates the frontward movement, of the second feed tray 22, from the fourth position.

<Removing Operation and Inserting Operation of First Feed Tray 21 and Second Feed Tray 22>

In the following, an explanation will be given about a removing operation and an inserting operation for removing and inserting the first and second feed trays 21 and 22 with respect to the printer casing 14, with reference to FIGS. 6 to 10.

At first, the removing operation for removing the first feed tray 21 from the printer casing 14 will be explained. The first feed tray 21 in the state of being located at the first position (see FIG. 6) is moved frontwardly while being supported with respect to the printer casing 14 by the supporting plate 46. In a case that the first feed tray 21 reaches the second position, each of the projecting portions 77 makes contact with one of the contacting portions 84 from the rear side thereof, as depicted in FIG. 7. With this, the forward movement of the first feed tray 21 from the second position is regulated by the first regulating section 91.

In a case that a front portion of the first feed tray 21 in this state is lifted upwardly by a user, the first feed tray 21 is rotated in a direction indicated by an arrow 103 about a rear end portion 21A of a portion, of the first feed tray 21, making contact with the supporting plate 46 as the fulcrum, such that another portion, of the first feed tray 21, which is located away from the fulcrum in the front direction is moved upwardly. With this rotation, the projecting portion 77 is moved upwardly.

Figure 8:
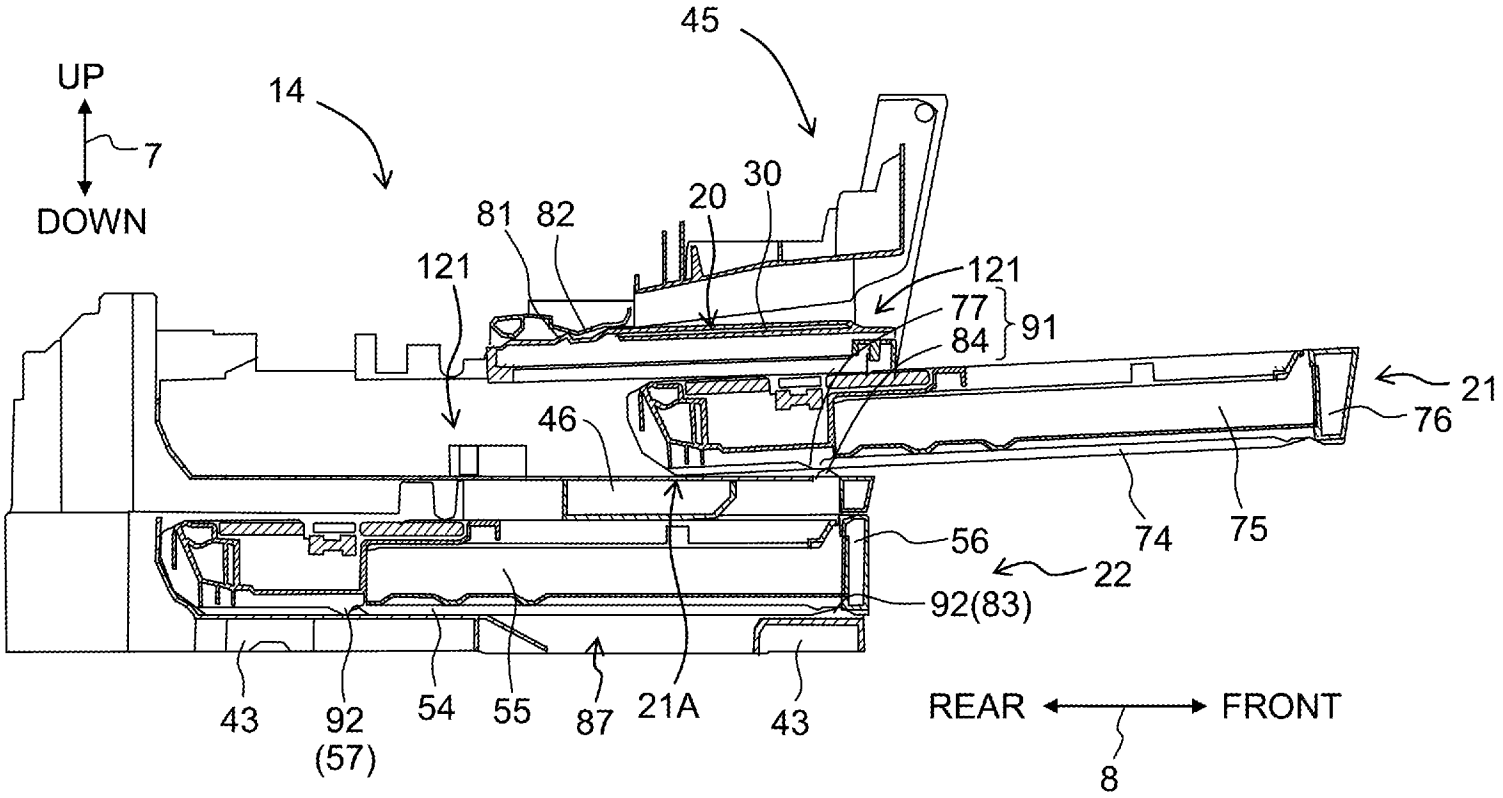
FIG. 8 is a vertical cross-sectional view of the lower portion of the printer casing 14, depicting a state that the first feed tray 21 is rotated from the second position and that the second feed tray 22 is located at the third position.

In a case that the first feed tray 21 is moved upwardly by an amount which is not less than a first predetermined moving amount by the rotation of the first feed tray 21 in the direction of the arrow 103, then as depicted in FIG. 8, the projecting portion 77 is allowed to be located above the contacting portion 84. With this, the regulation to the forward movement of the first feed tray 21 from the second position is released, thereby allowing the first feed tray 21 to be moveable frontwardly. As a result, the first feed tray 21 is allowed to be removable from the printer casing 14.

Here, the first predetermined moving amount is an upward moving amount, among upward moving amounts of an internally located portion included in the first feed tray 21 in the state of being located at the second position and located in the internal space 121, by which the internally located portion is allowed to reach a maximally moving location (in this embodiment, a front end portion of the internally located portion). The first predetermined moving amount is longer than the spacing distance in the up/down direction 7 between the first feed tray 21 and the discharge tray 20 in the state depicted in FIG. 7. With this, in the rotating process of the first feed tray 21 in the direction of the arrow 103, the discharge tray 20 is being contacted and pressed by the first feed tray 21 from therebelow (from the lower side of the discharge tray 20). As a result, the discharge tray 20 is rotated in the direction of the arrow 102.

Here, in a case that the first feed tray 21 is moved upwardly by the first predetermined moving amount from the state depicted in FIG. 7, a rotating amount by which the discharge tray 20 is rotated by being pressed by the first feed tray 21, is less than the above-described predetermined rotating amount, namely, less than the rotating amount required for locating each of the projecting portions 81 at a location below one of the contacting portions 82. With this, the discharge tray 20 is not removed or detached from the printer casing 14 due to the rotation of the first feed tray 21 in the direction of the arrow 103.

Next, the inserting operation for inserting the first feed tray 21 to the printer casing 14 will be explained. The first feed tray 21 is inserted rearwardly with respect to the printer casing 14, while being supported by the supporting plate 46. Then, each of the projecting portions 77 makes contact with one of the contacting portions 84 from the front side thereof. With this, the insertion of the first feed tray 21 to the printer casing 14 is regulated. In this situation, by rotating the first feed tray 21 in the direction of the arrow 103 (see FIG. 7), this regulation is released. As a result, the first feed tray 21 is inserted further rearward and is allowed to be installable to the printer casing 14. Note that also in this situation, similarly to the removable of the first feed tray 21, the discharge tray 20 is pressed by the first feed tray 21 and thus rotated in the direction of the arrow 102.

Next, the removing operation for removing the second feed tray 22 from the printer casing 14 will be explained.

The second feed tray 22 in the state of being located at the third position (see FIG. 6) is moved frontwardly while being supported with respect to the printer casing 14 by the bottom portion 43. In a case that the second feed tray 22 reaches the fourth position, each of the projecting portions 57 makes contact with one of the contacting portions 83 from the rear side thereof, as depicted in FIG. 9. With this, the forward movement of the second feed tray 22 from the fourth position is regulated by the second regulating section 92.

Figure 10:
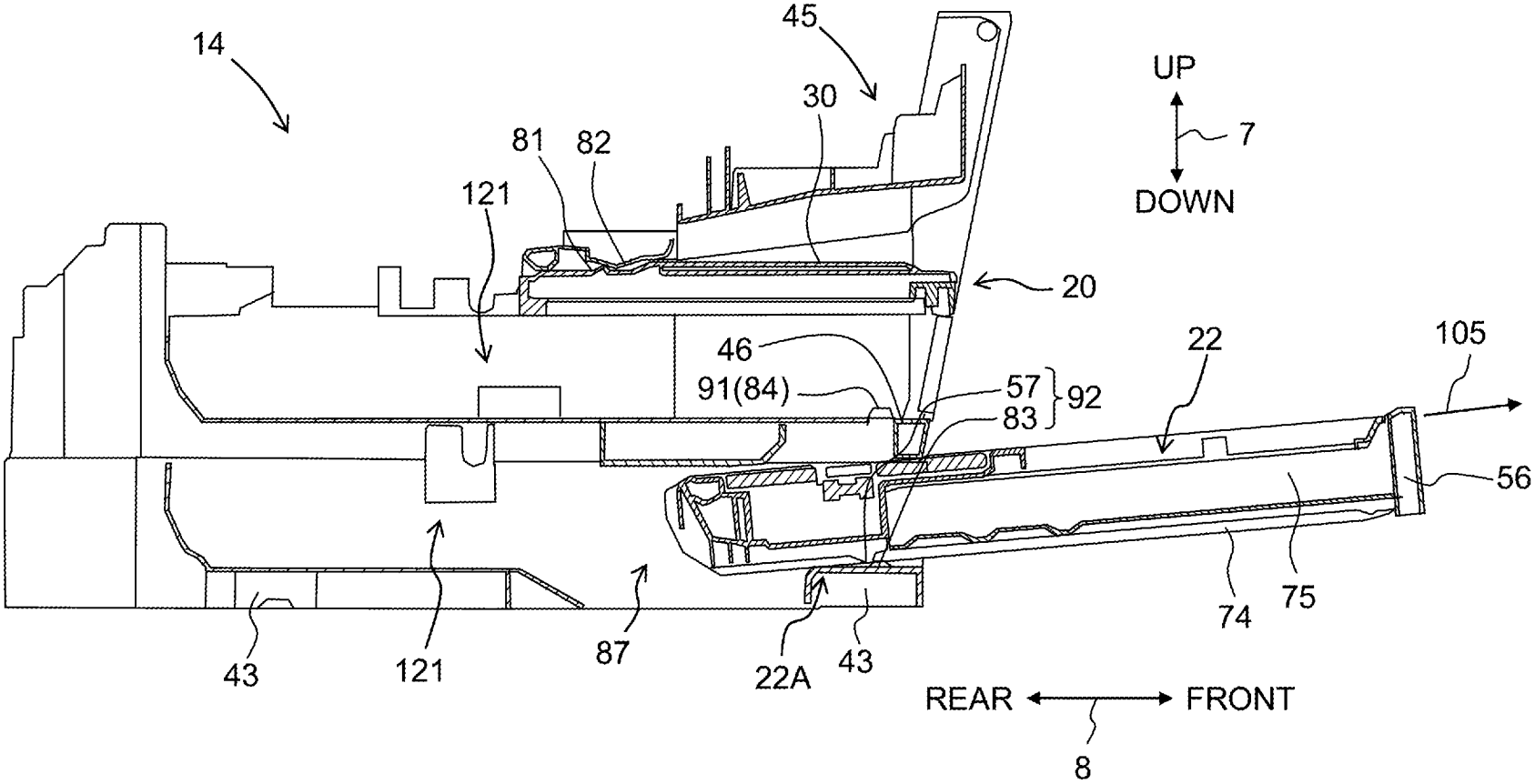
FIG. 10 is a vertical cross-sectional view of the lower portion of the printer casing 14, depicting a state that the first feed tray 21 is removed and that the second feed tray 22 is rotated from the fourth position.

In a case that a front portion of the second feed tray 22 in this state is lifted upwardly by the user, the second feed tray 22 is rotated in a direction indicated by an arrow 104 about a portion 22A, of the second feed tray 22, making contact with a portion, of the bottom portion 43, which is located away from the recess 87 in the front direction as the fulcrum. In this situation, another portion of the second feed tray 22 which is located away from the fulcrum in the rear direction is moved downwardly such that the another portion is accommodated in the recess 87, as depicted in FIG. 10. With this, yet another portion, of the second feed tray 22, which is located away from the fulcrum in the front direction is allowed to be movable upwardly by a second predetermined moving amount. Here, the second predetermined moving amount is an upward moving amount, among upward moving amounts of an internally located portion included in the second feed tray 22 in the state of being located at the fourth position and located in the internal space 121, by which the internally located portion is allowed to reach a maximally moving location (in this embodiment, a front end portion of the internally located portion).

By the upward movement of the second feed tray 22 by the second predetermined moving amount, the second feed tray 22 is inclined with respect to the front/rear direction 8. By being inclined with respect to the front/rear direction 8, the second feed tray 22 is allowed to be movable in an inclination direction 105 (see FIG. 10) brought about by this inclination. Further, in a case that the second feed tray 22 is moved in the inclination direction 105, each of the projecting portions 57 is moved to a location in front of one of the contacting portions 83, without being prevented by the contacting portion 83. Namely, the regulation to the forward movement of the second feed tray 22 from the fourth position is released. As a result, the second feed tray 22 is allowed to be removable from the printer casing 14. As described above, the regulation by the second regulating section 92 can be released by allowing the second feed tray 22 in the state of being located at the fourth position to move by the second predetermined moving amount.

Next, the inserting operation for inserting the second feed tray 22 to the printer casing 14 will be explained. The second feed tray 22 is inserted rearwardly with respect to the printer casing 14, while being supported by the bottom portion 43. Then, each of the projecting portions 57 makes contact with one of the contacting portions 83 from the front side thereof. With this, the insertion of the second feed tray 22 to the printer casing 14 is regulated. In this situation, by rotating the second feed tray 22 in the direction of the arrow 104 (see FIG. 9), this regulation is released. As a result, the second feed tray 22 is inserted further rearward and is allowed to be installable to the printer casing 14. Note that also in this situation, in a state that the projecting portions 57 are located respectively on the rear side of the contacting portions 83, the second feed tray 22 is returned to a state of being along the front/rear direction 8 from the state of being inclined with respect to the front/rear direction 8. With this, the second feed tray 22 can be appropriately inserted to the printer casing 14, without allowing a rear end portion (insertion-leading portion) of the second feed tray 22 to make contact with a portion, of the bottom portion 43, which defines a rear end portion of the recess 87.

According to the embodiment, in a case that the regulation by the first regulating section 91 is released, the first feed tray 21 can move to a space at which the discharge tray 20 has been present previously. Namely, according to the embodiment, the space which is configured to allow the discharge tray 20 to be present therein and the space which is configured to allow the first feed tray 21 to move thereinto can be made common. With this configuration, it is possible to suppress the size of the multi-function peripheral 10 from becoming large. Further, also with this configuration, there is no need to reduce the thickness in the up/down direction 7 of the first feed tray 21, and thus the rigidity of the first feed tray 21 can be maintained to be high.

Further, according to the embodiment, the rotating amount by which the discharge tray 20 is rotated by being contacted by the first feed tray 21, in the case that the first feed tray 21 which has been in the state of being located at the second position is moved upwardly by the first predetermined moving amount, is less than the predetermined rotating amount which is required for removing the discharge tray 20 from the printer casing 14. With this, it is possible to prevent the discharge tray 20 from being removed (detached) from the printer casing 14 when the first feed tray 21 is being removed from the printer casing 14.

Furthermore, according to the embodiment, the first feed tray 21 is movable into the space in which the discharge tray 20 has been previously present. Accordingly, it is possible to allow the pair of first side plates 75 of the first feed tray 21 to have a height same as that of the front plate 76 of the first feed tray 21. By doing so, the rigidity of the first feed tray 21 can be maintained to be high.

Moreover, according to the embodiment, in a case that the regulation by the second regulating section 92 is released, the rear end portion of the second feed tray 22 is moved downwardly and is accommodated in the recessed portion 87. This regulates the upward movement of the portion, of the second feed tray 22, which is located in front of the fulcrum. As a result, the spacing distance in the up/down direction 7 of the second feed tray 22 and the supporting plate 46 can be made small. With the above-described configuration, it is possible to suppress the size of the multi-function peripheral 10 from becoming large. In addition, there is no need to thin the thickness in the up/down direction 7 of the second feed tray 22, and thus the rigidity of the second feed tray 22 can be maintained to be high.

Further, according to the embodiment, a portion of the second feed tray 22 can be accommodated in the recessed portion 87. Accordingly, it is possible to allow the pair of side plates 55 of the second feed tray 22 to have a height same as that of the front plate 56 of the second feed tray 22. By doing so, the rigidity of the second feed tray 22 can be maintained to be high.

Furthermore, according to the embodiment, the first feed tray 21 and the second feed tray 22 are both in a state of being accommodated inside the printer casing 14 in a state that the first and second feed trays 21 and 22 are installed in the printer casing 14. Accordingly, the movable range of the first and second feed trays 21 and 22 is restricted to a limited space inside the printer casing 14. However, owing to the configuration in the embodiment as described above, the limited moving space for the first and second feed trays 21 and 22 is utilized effectively.

Modification

In the above-described embodiment, the first regulating section 91 is provided with the projecting portions 77 and the contacting portions 84, and the second regulating section 92 is provided with the projecting portions 57 and the contacting portions 83. The configurations of the first and second regulating sections 91 and 92 are, however, not limited to the configuration of the above-described embodiment.

Figure 11A:
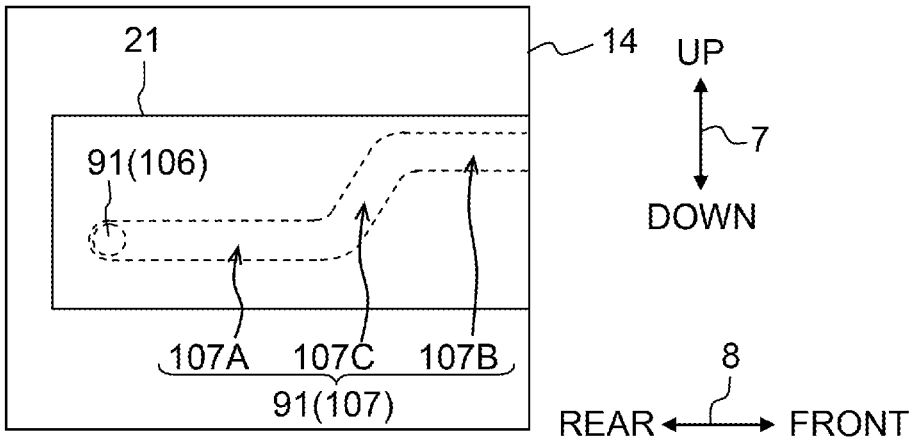
FIGS. 11A to 11C are each a vertical cross-sectional view schematically depicting a printer casing 14 and a first feed tray 21 in a modification.
Figure 11B:
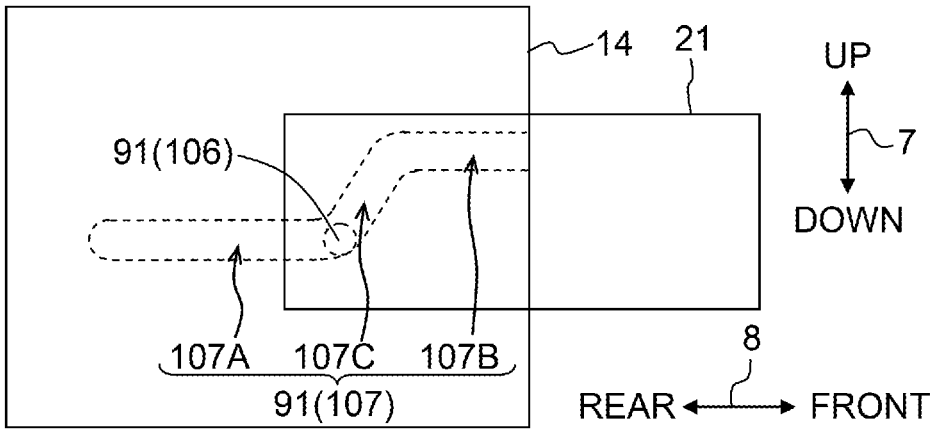
Figure 11C:
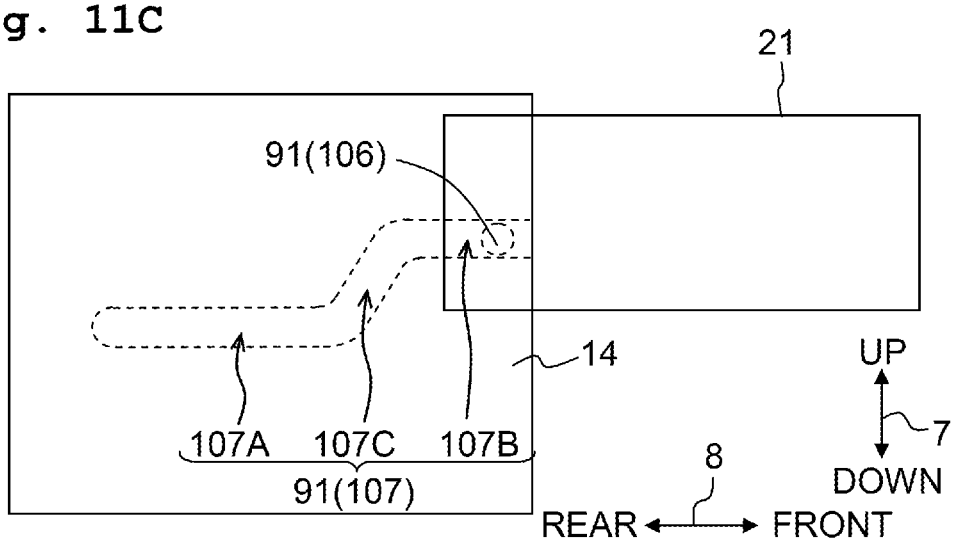

For example, as depicted in FIGS. 11A to 11C, it is allowable that the first regulating section 91 includes projecting portions 106 projecting outwardly in the left/right direction 9 respectively from the pair of side plates 75 of the first feed tray 21; and grooves 107, which are provided respectively on the side surfaces 48 and 50 of the printer casing 14, substantially along the front/rear direction 8 and to which the projecting portions 106 can be insertable, respectively. Each of the grooves 107 is formed of a lower groove 107A, an upper groove 107B which is located above the lower groove 107A, and a connecting groove 107C connecting the lower groove 107A and the upper groove 107B. Note that the second regulating section 92 also may include projecting portions and grooves, similarly to the first regulating section 91.

In a case that the first feed tray 21, which is moving frontwardly from the first position as indicated in FIG. 11A, reaches the second position, then as indicated in FIG. 11B, each of the projecting portions 106 makes contact with an edge portion defining the connecting groove 107C. This regulates the forward movement of the first feed tray 21 from the second position. In a case that the first feed tray 21 is lifted upward by a user, each of the projecting portions 106 is thereby moved along the connecting groove 107C, and reaches the upper groove 107B (see FIG. 11C).

In the embodiment, although the first feed tray 21 is moved such that the rotation of the first feed tray 21 releases the regulation brought about by the first regulating section 91, the first feed tray 21 may be moved in a manner different from the rotation. For example, the first feed tray 21 may slide in the up/down direction 7, instead of rotating.

In the embodiment, in the case that the first feed tray 21 is located at the first position, the projecting portions 77 are away from the contacting portions 84, respectively, and in the case that the second feed tray 22 is located at the third position, the projecting portions 57 are away from the contacting portions 83, respectively. It is allowable, however, that in the case that the first feed tray 21 is located at the first position, each of the projecting portions 77 may make contact with one of the contacting portions 84 from the rear side thereof, and in the case that the second feed tray 21 is located at the third position, each of the projecting portions 57 may make contact with one of the contacting portions 83 from the rear side thereof. In other words, the first regulating section 91 may regulate the forward movement of the first feed tray 21 in the state of being located at the first position, and the second regulating section 92 may regulate the forward movement of the second feed tray 22 in the state of being located at the third position. Namely, the first position and the second position may be a same position, and that the third position and the fourth position may be a same position.

In the embodiment, each of the first feed tray 21 and the second feed tray 22 is moved in the front/rear direction 8. It is allowable, however, that the moving directions of the first and second feed trays 21 and 22 may be different from each other. For example, the first feed tray 21 may be moved in an inclined direction which is inclined relative to the front/rear direction 8.

In the embodiment, the conveying apparatus is provided with the two feed trays (the first feed tray 21 and the second feed tray 22). However, the number of the tray provided on the conveying apparatus is not limited to 2 (two). For example, the conveying apparatus may be provided with only the first feed tray 21.

In the embodiment, the front surface 43A of the bottom portion 43, the front surface 46A of the supporting plate 46, the front surface 76A of the front plate 76 of the first feed tray 21 in the state of being located at the first position, and the front surface 56A of the front plate 56 of the second feed tray 22 in the state of being located at the third position are in a same surface with the front surface 19 of the multi-peripheral 10. Namely, the four front surfaces that are the front surface 43A, the front surface 46A, the front surface 76A and the front surface 56A are in the same surface with one another. It is allowable, however, that the front surface 76A and the front surface 46A are in a same surface with each other, and that the front surface 56A and the front surface 43A are in a same surface with each other. Namely, it is allowable that the front surfaces 76A and 46A are not in a same surface with the front surfaces 56A and 43A.

In the above embodiment, the conveying apparatus is provided on the printer section 12 which is an example of the image recording apparatus. It is allowable, however, that the conveying apparatus is provided on another portion different from the printer section 12. For example, the conveying apparatus may be provided on the scanner section 11. In this case, the first and second feed trays 21 and 22 support a manuscript (original) with an image thereon which is to be read by the scanner section 11. Further, the discharge tray 20 supports the discharged manuscript of which image has been read by the scanner section 11 and is discharged from the scanner section 11.

What is claimed is:

1. A conveying apparatus configured to convey a sheet, comprising:

a main body including a conveyance path via which the sheet is conveyed;

a first feed tray which is installable in the main body at a first position by being inserted into the main body in a first direction, crossing an up/down direction, through an opening formed in the main body, and which is configured to support the sheet to be fed to the conveyance path, wherein the first feed tray is movable in a second direction opposite the first direction from the first position to a second position in which a portion of the first feed tray extends from the main body; and a discharge tray which is arranged above the first feed tray when the first feed tray is at the first position and which is configured to support the sheet discharged from the conveyance path, wherein a spacing distance in the up/down direction between the first feed tray and the discharge tray is shorter than a first predetermined moving amount, wherein the discharge tray is configured to move upwardly in response to contact with the first feed tray when the first feed tray is moved upwardly, wherein the discharger tray is rotatable, wherein the discharge tray is removable from the main body in response to rotation of the discharge tray by a predetermined rotating amount, and wherein the discharge tray is rotate less than the predetermined rotating amount in response to the contact with the first feed tray when the first feed tray is moved upwardly by the first predetermined moving amount.

2. The conveying apparatus according to claim 1, wherein the first feed tray includes:

a first bottom wall having a sheet supporting surface and configured to support the sheet on the sheet supporting surface;

a first upstanding wall provided upstandingly and upwardly at an end portion of the first bottom wall; and a pair of first side walls which are provided upstandingly and upwardly at respective side portions of the first bottom wall, and wherein upper end portions of the pair of first side walls are located at a height the same as that of an upper end portion of the first upstanding wall.

3. The conveying apparatus according to claim 2, wherein the first feed tray is integrally formed with a resin.

4. The conveying apparatus according to claim 1, wherein the main body includes: a first supporting wall configured to support the first feed tray in the state of being located inside the main body; and a second supporting wall which is arranged at a location below the first supporting wall, the second supporting wall defining a recess therein, the conveying apparatus further including:

a second feed tray which is installable in the main body at a third position by being inserted into the main body in the first direction, crossing the up/down direction, through the opening, which is supported by the second supporting wall in a state of being located inside the main body, and which is configured to support the sheet to be fed to the conveyance path, wherein the second feed tray is movable in the second direction from the third position to a fourth position in which a portion of the second feed tray extends from the main body, wherein in response to the upward movement of the second feed tray from the fourth position, an end portion of the second feed tray opposite the portion of the second feed tray that extends from the main body moves downwardly and is accommodated in the recessed portion.

5. The conveying apparatus according to claim 4, wherein the second feed tray includes:

a second bottom wall having a sheet supporting surface and configured to support the sheet on the sheet supporting surface;

a second upstanding wall provided upstandingly and upwardly at an end portion of the second bottom wall;

a pair of second side walls which are provided upstandingly and upwardly at respective side portions of the second bottom wall; and upper end portions of the pair of second side walls are located at a height the same as that of an upper end portion of the second upstanding wall.

6. The conveying apparatus according to claim 5, wherein the second feed tray is integrally formed with a resin.

7. The conveying apparatus according to claim 4, wherein an end surface of the first feed tray in the state of being located at the first position is flush with an end surface of the first supporting wall, and an end surface of the second feed tray in the state of being located at the third position is flush with an end surface of the second supporting wall.

8. An image recording apparatus comprising:

the conveying apparatus as defined in claim 1; and a recording head configured to record an image on a sheet conveyed via the conveyance path.

* * * * *